US005542121A

United States Patent [19]

Lahaussois et al.

[11] Patent Number: 5,542,121

[45] Date of Patent: Aug. 6, 1996

[54] DISPENSABLE, DISPOSABLE REVERSIBLE FOREARM PROTECTOR

[75] Inventors: Pierre Lahaussois, Darien, Conn.; Margaret T. Strohl, New Hope, Pa.

[73] Assignee: Dale Strohl, Ridgefield, Conn.; a partial interest

[21] Appl. No.: 269,149

[22] Filed: Jun. 30, 1994

[51] Int. Cl.[6] ..... A41D 13/08; A41D 27/12

[52] U.S. Cl. ..... 2/59; 2/16

[58] Field of Search ..... 2/16, 59, 60, 170, 2/158, 61, 125, 159

[56] References Cited

U.S. PATENT DOCUMENTS

| | | | |
|---|---|---|---|
| 18,343 | 5/1888 | O'Brien | 2/59 |
| 1,360,840 | 11/1920 | White . | |
| 2,058,040 | 10/1936 | Severn | 2/59 |
| 2,832,074 | 4/1958 | Wheeler | 2/16 |
| 3,189,919 | 6/1965 | Chase | 2/16 |
| 3,657,741 | 4/1972 | Blanco | 2/59 |
| 3,916,447 | 11/1975 | Thompson | 2/46 |
| 4,014,046 | 3/1977 | Craig | 2/60 |
| 4,504,978 | 3/1985 | Gregory, Jr. et al. | 2/59 |
| 4,677,697 | 7/1987 | Hayes | 2/159 |
| 4,856,112 | 8/1989 | Effle | 2/59 |
| 4,893,372 | 1/1990 | Wenzel | 2/16 |
| 4,916,757 | 4/1990 | Berlin et al. | 2/159 |
| 4,928,322 | 5/1990 | Bradfield | 2/158 |
| 4,964,176 | 10/1990 | Previdi | 2/46 |
| 5,063,919 | 11/1991 | Silverberg | 2/16 |
| 5,187,813 | 2/1993 | Klein | 2/59 |
| 5,392,786 | 2/1995 | Lewis et al. | 2/59 |
| 5,402,536 | 4/1995 | Matthews | 2/59 |

FOREIGN PATENT DOCUMENTS

| | | | |
|---|---|---|---|
| 128715 | 1/1929 | Switzerland | 2/59 |

*Primary Examiner*—Amy B. Vanatta

*Attorney, Agent, or Firm*—Schweitzer, Cornman & Gross

[57] ABSTRACT

A dispensable, disposable reversible forearm protector is made up from continuous webs of composite material. Each of two laminated webs, comprised of a layer of soft, absorbent paper toweling or the like and a moisture impermeable layer of thermoplastic or similar material, is arranged face-to-face with the other and joined by heat sealing or other means along generally transverse strip-like bonding areas of the web to form rectangular or trapezoidal segments of the web. Lines of weakness running along the strip-like bonding areas allow successive segments to be detached from the web. Each segment forms a flat, tubular element, which is expandable to circular form so as to receive the hand and forearm of a user. Preferably, the bonding areas are angled so that the individual segments are of trapezoidal shape, providing a tapered tubular configuration for better conformance with the contours of the forearm. The device may be easily turned inside-out, so that the respective layers of absorbent material and moisture impermeable material may be placed on the inside or the outside as desired. The device is economical to produce and convenient to use and dispose of.

1 Claim, 3 Drawing Sheets

FIG. 3
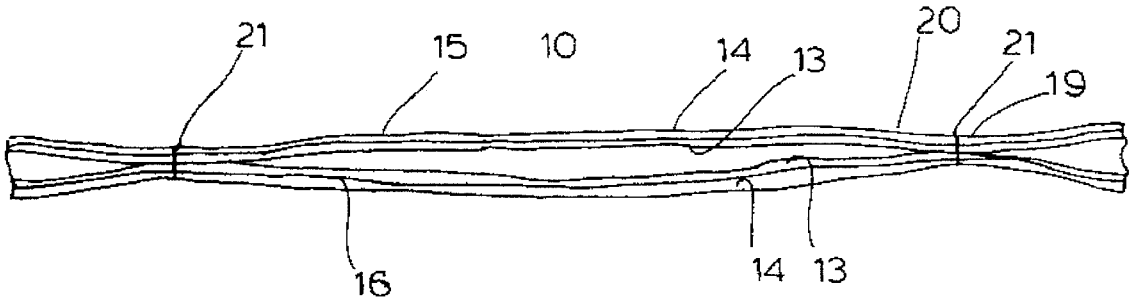
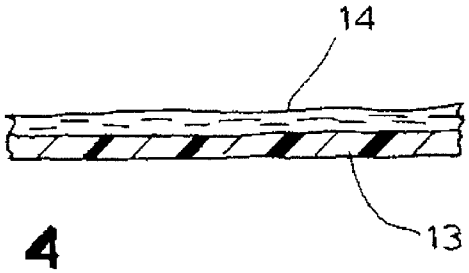
FIG. 4
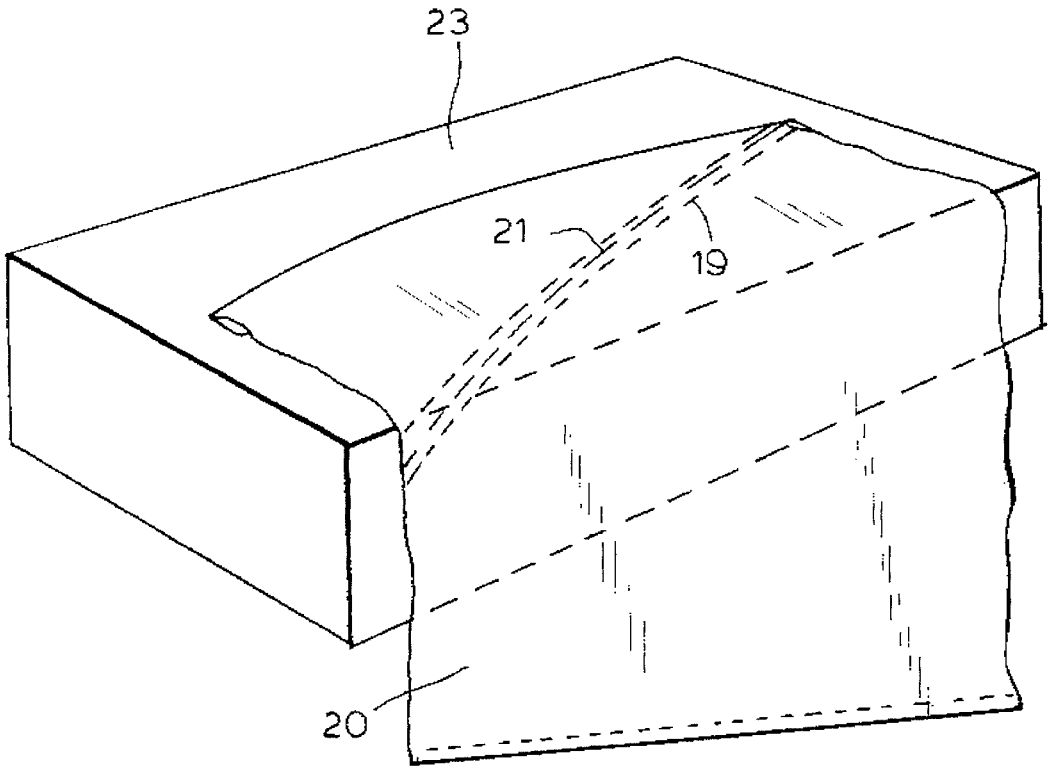
FIG. 5

DISPENSABLE, DISPOSABLE REVERSIBLE FOREARM PROTECTOR

BACKGROUND AND SUMMARY OF THE INVENTION

There is a need in certain areas of endeavor for the use of a protective covering for the forearm. Such a device is usefully employed by, for example, artists, craftsmen, cooks and other food processors, medical personnel and the like, who handle liquid or semi-liquid materials. There are examples in the prior art of devices useful for this purpose. However, insofar as we are aware, all of the prior art devices suffer from certain shortcomings, either in the area of performance, high cost, difficulty or inconvenience of use, or combinations of one or more of the foregoing.

Pursuant to the invention, a simple, highly effective, reversible forearm cover device is provided, which is inexpensive to produce, conveniently dispensed and utilized, and easily disposed of. In a preferred embodiment of the invention, a protective web material is formed of a composite laminate comprised of a plastic film on one side and paper toweling on the other. Two such composite webs are arranged face-to-face, with the plastic film layers on the inside, and the composite web laminates are joined together along spaced-apart, strip-like bonding areas by heat sealing or otherwise. The strip-like bonding areas extend along generally transverse lines to form successive sections of flat tubular form. Lines of weakness extend transversely along the bonding areas, to enable successive flat tubular sections to be torn free of an otherwise continuous supply of the web material. Preferably, individual tubular sections of the material are formed of trapezoidal configuration, narrower at one end than the other, to conform better to typical forearm contours. Where desired, elastic or expandable bands may be provided separately, for securing the forearm protectors snugly to the wearer during use.

The device of the invention may be easily dispensed in continuous roll form, or from a box. If desired, the protector devices may be pre-cut and dispensed individually.

For a more complete understanding of the above and other features and advantages of the invention, reference should be made to the following detailed description of preferred embodiments of the invention and to the accompanying drawings.

IN THE DRAWINGS

FIG. 3 is an enlarged cross-sectional view as taken generally on line 3—3 of FIG. 2.

FIG. 4 is a further enlargement of a section of FIG. 3 illustrating the laminated construction of a preferred material used in the invention.

FIG. 5 is a perspective illustration of the device of the invention employed with a box style of dispenser.

DESCRIPTION OF PREFERRED EMBODIMENTS

Figure 1:
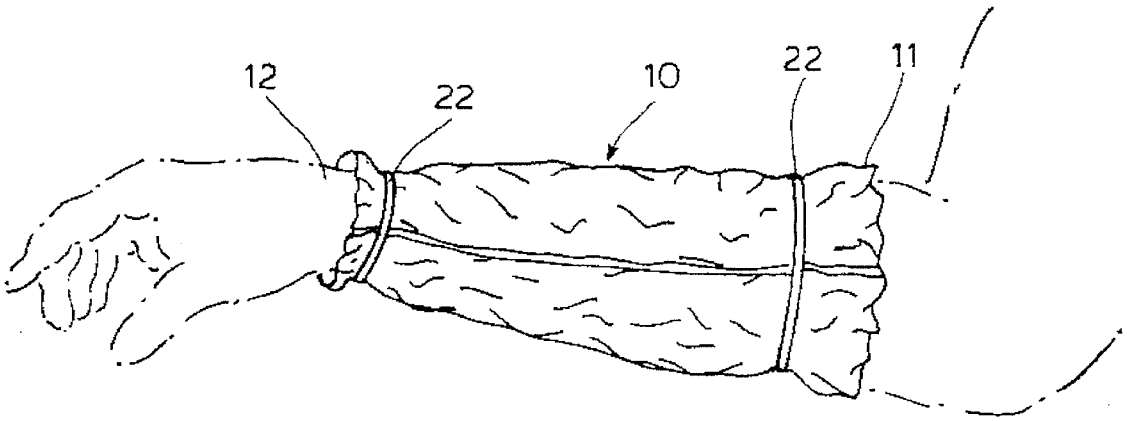
FIG. 1 is a representative view of a forearm protector according to the invention as applied over a user's forearm.

Referring now to the drawing, and initially to FIGS. 1–4, the reference numeral 10 designates generally a forearm protector according to the invention, which preferably is in the form of a tapered, tubular sleeve open at each end 11, 12 and adapted to be received over the hand and forearm of the user. To advantage, the tubular sleeve 10 is formed of a laminated material, with a thin layer of moisture impermeable plastic (preferably thermoplastic) film 13 on the inside and a layer of absorbent paper toweling or similar material 14 on the outside. The laminated material desirably is produced in the form of continuous webs 15, 16.

As shown in FIG. 3, a pair of continuous webs 15, 16 is arranged in superposed relation, with the respective thermoplastic webs in face-to-face contact. The respective webs 15, 16 are then joined together from one side edge 17 to the other side edge 18 along narrow, generally transverse strip-like bonding areas 19. Typically, the joining is accomplished by heat sealing techniques, although suitable adhesive or solvent bonding, for example, could also be employed. Desirably, successive bonding areas 19 along the length of the web material are oriented at opposite shallow angles with respect to a transverse axis, such that each section 20, between successive sealing areas 19, is in the form of a trapezoid.

Figure 2:
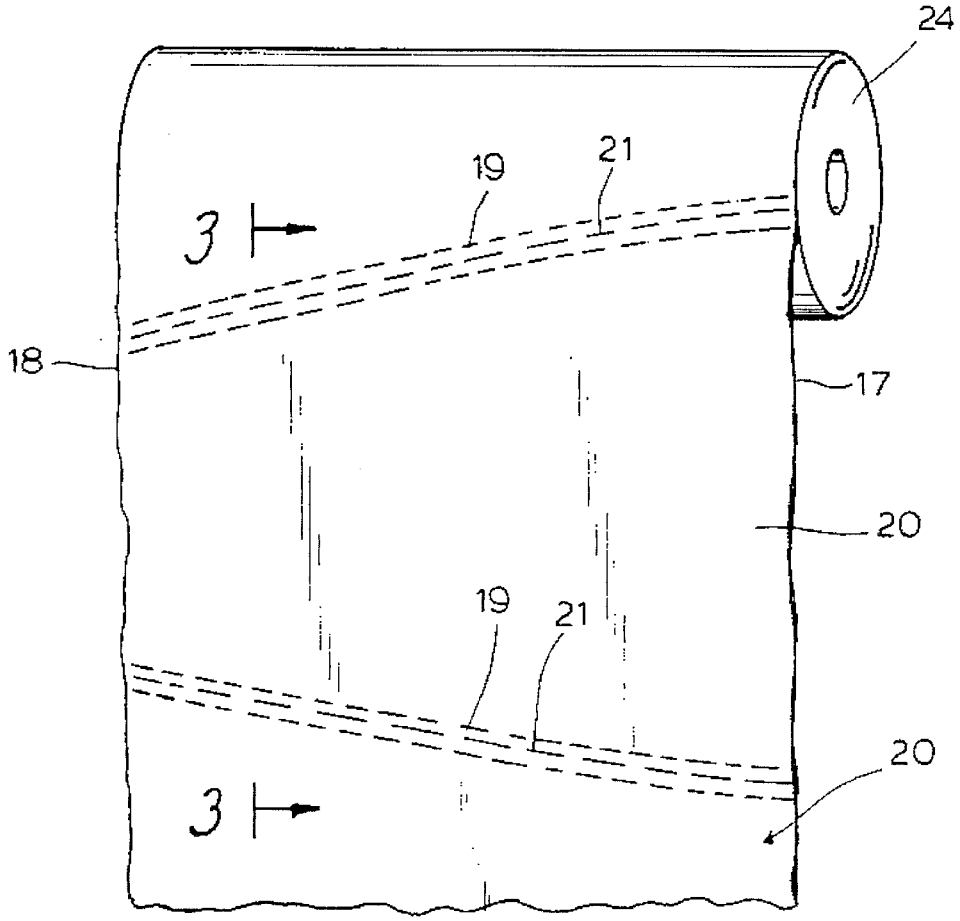
FIG. 2 is a perspective view of a roll supply of forearm protectors according to the invention.

In the illustration of FIG. 2, the composite web material is supplied in a continuous roll form, and lines of weakness 21, such as lines of perforation, score lines or the like, are provided more or less centrally within the bonding areas 19, to allow individual segments 20 to be torn away from the roll supply, much the same as individual paper towels are torn away from their supply rolls.

Preferably, the individual composite webs 15, 16 are formed by laminating the respective webs of absorbent toweling and plastic film over their full surfaces. However, where preferred, the webs may be bonded together in limited areas, possibly only at the edge bands 19.

The product of FIG. 2 is utilized by tearing off the endmost segment 20 and opening the tubular section formed thereby to the configuration of a tapered open tube of generally circular cross section. The hand of the user is inserted into the larger end of the tapered tube and passed entirely through the tube until the sleeve is positioned on the user's forearm as shown in FIG. 1. Typically, the spacing between successive bonding areas 19 is such that the tapered sleeve formed thereby is large enough to fit over a relatively large forearm. Accordingly, the supply of protective sleeves may include elastic or expandable bands 22, one or more of which can be slipped over the protective sleeve to hold it in position on the user's forearm.

In the form of the invention shown in FIG. 5, a continuous web-form supply of detachable sleeve sections 20 is supplied in a dispensing box 23, instead of a continuous roll 24 as in FIG. 2. In general, however, the utilization is the same as with the roll supply of FIG. 2, in that individual sections 20 are torn off of the web supply along predefined lines of weakness 21 formed in the strip-like bonding areas 19.

Where desired, the individual sleeve sections 20 may be precut from the web supply and furnished in a dispenser box 23, much in the manner of box-dispensed facial tissues, for example.

The reversible protective sleeve device of the invention is useful to great advantage by individuals dealing with liquid or semi-liquid materials. Where there is frequent need to wipe the hands and/or utensils with a minimum interruption in the ongoing work, the absorbent paper layer provides a convenient medium. By way of example, excessive liquid can be removed from a small paintbrush by simply wiping it across a forearm protected with one of the protecting sleeves. The liquid material is readily absorbed by the outer surface of paper toweling, while the plastic liner prevents penetration to the inside of the sleeve.

Figure 7:
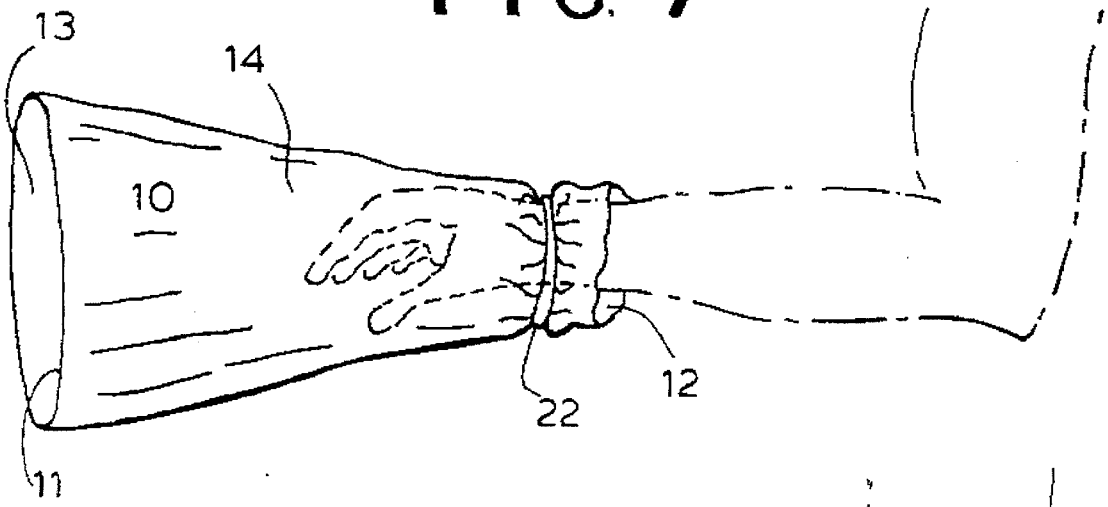
FIGS. 6–8 are a sequence of views illustrating the manner in which the forearm protector of the invention is applied in a reverse or inside-out orientation.
Figure 8:
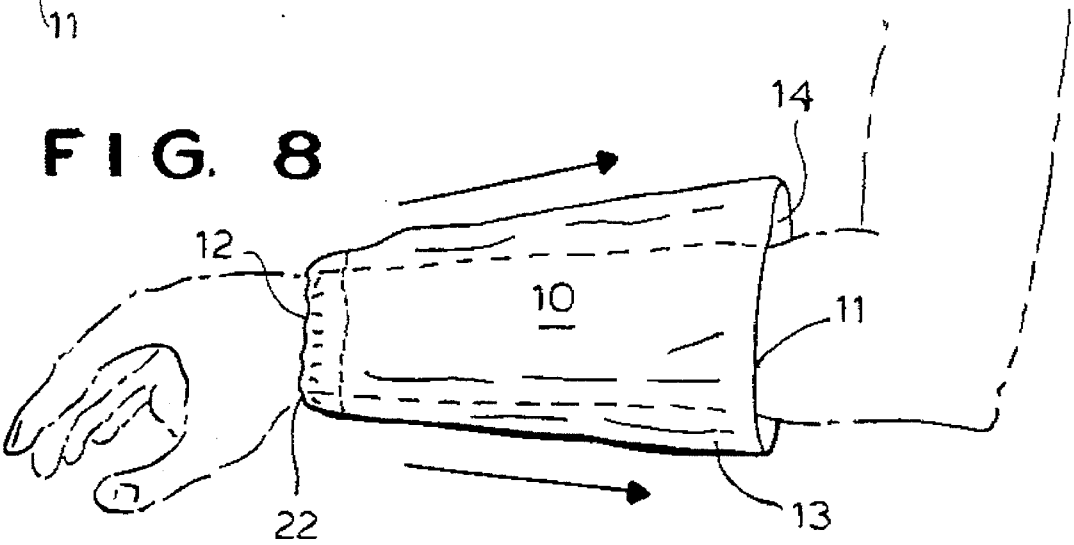
Figure 6:
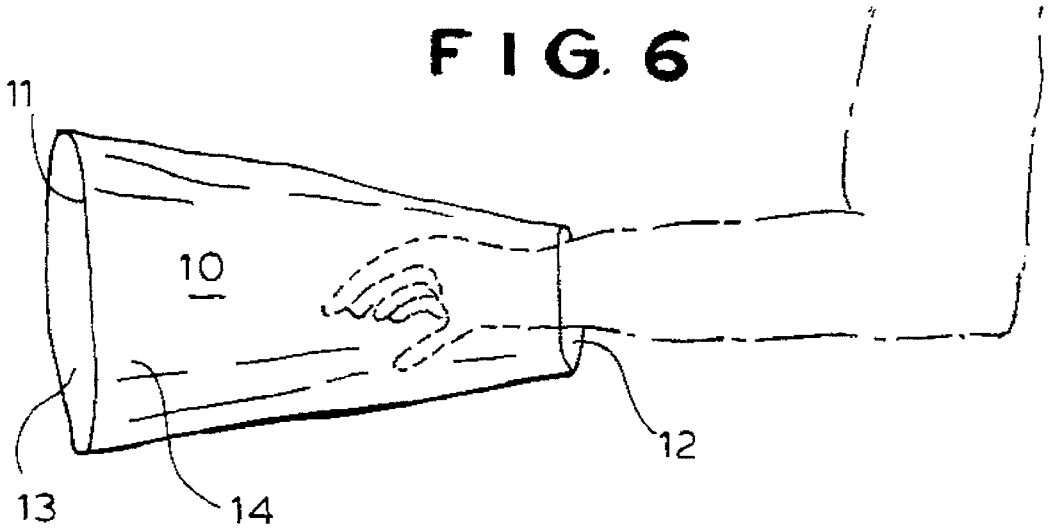

For certain tasks, such as pottery throwing, certain cooking operations, etc., it may be unnecessary, or perhaps even undesirable to provide for liquid absorption on the exterior of the protective sleeve. In such cases, the sleeve can be utilized in a reverse orientation, as shown in FIGS. 6–8. For this manner of use, the sleeve protector, in its normal, paper outside orientation, is applied over the forearm small end first, which is opposite to the normal application. An elastic or expandable band 22 is applied over the sleeve end 12, substantially as shown in FIG. 7, causing the end of the sleeve protector to be lightly gripped about the wrist or the outer forearm of the user. Next, the large diameter (outer) end of the sleeve protector is gripped and drawn over the forearm, in the manner shown in FIG. 8. In the process, the sleeve protector is turned inside out, with the absorbent paper layer on the inside and the water impervious plastic layer on the outside.

When a task is completed, or when a protective sleeve becomes excessively covered with wiped-off materials, the sleeves can be simply discarded.

Although a laminated sleeve material comprised of paper toweling and thermoplastic film is ideal for most uses, it may be appropriate in some cases to utilize single materials, such as the film alone or the paper toweling alone, depending upon the service for which the device is intended to be used.

The device of the invention is highly simplified, economical to manufacture, easy to use and easy to dispose of. The materials can be produced in continuous forms by joining of separate laminates 15, 16 in face-to-face relation, along narrow, generally transverse strip-like bonding areas, with lines of weakness being provided along the bonding areas to accommodate separation of individual sections of protector sleeve material at the time of use.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A dispensable, disposable and reversible forearm protector, which comprises (a) an opposed pair of first sheet-like elements of trapezoidal configuration having parallel end edges and convergent side edges whereby one of said end edges is of smaller dimensions than the other, (b) said first sheet-like elements being formed of liquid impervious thermoplastic material and being sealed together along narrow margins of said convergent side edges and being separable in all areas except said narrow margins, (c) a pair of second sheet-like elements of identical trapezoidal configuration to said first sheet-like elements and bonded to outer surfaces of said first sheet-like elements in directly overlying relation thereto, (d) said second sheet-like elements being formed of an absorbent paper material, (e) said bonded sheet-like elements forming a tapered tubular structure, open at both ends, for receiving a hand, wrist and forearm of a user, with the hand exposed, and having respective smaller and larger openings at opposite ends, (f) a marginal portion of said tubular structure at the end with said smaller opening being positioned on said wrist with the end edge of smaller dimensions facing away from the hand, (g) an elastic means urging said marginal portion snugly against said wrist at a distance from said end edge of smaller dimensions, and (h) portions of said tubular structure extending from said marginal portion to the end with said larger opening being folded over at said elastic means and extending along the wrist and forearm of the wearer, whereby an exterior of said protector comprises said sheets of thermoplastic material, and an interior of said protector comprises said sheets of absorbent material.

* * * * *